US006536911B1

(12) United States Patent
DiAngelo

(10) Patent No.: US 6,536,911 B1
(45) Date of Patent: Mar. 25, 2003

(54) FLASHLIGHT HOLDER

(76) Inventor: Pasquale F. DiAngelo, 219 E. 23rd St., Ashtabula, OH (US) 44004

( * ) Notice: Subject to any disclaimer, the term of this patent is extended or adjusted under 35 U.S.C. 154(b) by 0 days.

(21) Appl. No.: 09/717,648

(22) Filed: Nov. 21, 2000

(51) Int. Cl.[7] ..... F21L 4/00

(52) U.S. Cl. ..... 362/190; 362/102; 362/396; 362/191; 33/772

(58) Field of Search ..... 362/253, 396, 362/190, 191, 102; 33/772, 775, 779

(56) References Cited

U.S. PATENT DOCUMENTS

| | | | | |
|---|---|---|---|---|
| 4,220,304 | A | 9/1980 | Wong et al. | |
| 4,542,447 | A | 9/1985 | Quakenbush | |
| 4,707,772 | A | 11/1987 | Jimenez et al. | |
| 4,799,132 | A | 1/1989 | Perlsweig | |
| 4,897,768 | A | 1/1990 | Thul | |
| 4,980,805 | A | 12/1990 | Maglica et al. | |
| 5,062,026 | A | 10/1991 | Maglica et al. | |
| 5,144,546 | A | 9/1992 | Burdi | |
| 5,163,752 | A * | 11/1992 | Copeland et al. | 362/191 |
| 5,181,774 | A | 1/1993 | Lane | |
| 5,291,900 | A * | 3/1994 | Lowenstein | 33/773 |
| 5,460,346 | A | 10/1995 | Hirsch | |
| 5,515,246 | A | 5/1996 | Maglica | |
| 5,601,356 | A * | 2/1997 | McWilliams | 224/221 |
| 5,816,684 | A | 10/1998 | Yu | |

* cited by examiner

*Primary Examiner*—Stephen Husar
*Assistant Examiner*—John Anthony Ward
(74) *Attorney, Agent, or Firm*—Renner, Kenner, Greive, Bobak, Taylor & Weber

(57) ABSTRACT

A flashlight holder for securing a flashlight to an object. The flashlight holder has a clamp assembly for attaching to the object. A cradle is provided for holding the flashlight. The cradle can be attached to the clamp assembly, or preferably, a riser can be disposed between the clamp assembly and the cradle. Retaining straps are provided to secure the flashlight in the cradle. The retaining straps are removably attached to allow the flashlight to be placed in and removed from the flashlight holder. A method of securing a flashlight to an object comprising: providing a flashlight holder comprising a clamp assembly having an opening end and a base end, a cradle disposed on the base end of the clamp assembly, and at least one retaining strap that attaches to the flashlight holder to secure a flashlight with an illumination end and a butt end in the flashlight holder, wherein the flashlight holder has a first end proximal to the illumination end of the flashlight, and a second end proximal to the butt end of the flashlight; attaching the flashlight holder to an object; and disposing the flashlight in the flashlight holder. A method of illuminating a wheeled measuring device and area surrounding the wheeled measuring device comprising: providing the wheeled measuring device; attaching a flashlight holder to the wheeled measuring device; disposing a flashlight in the flashlight holder; and powering the flashlight to provide illumination.

33 Claims, 3 Drawing Sheets

FLASHLIGHT HOLDER

FIELD OF THE INVENTION

The invention is directed to a flashlight holder that can be mounted onto an object to secure the flashlight to the object.

BACKGROUND OF THE INVENTION

When working in an area, it is sometimes desired to illuminate the area in order to view the area. Background light may be low or non-existent, such as at nighttime. In order to better illuminate the area, a portable light source, such as a flashlight, may be used. Flashlights generally require hand operation for use. Using one hand for a flashlight can diminish the ability to perform the desired work.

One particular situation requiring illumination is accident scene investigations. Typically after an accident, a law enforcement officer or an insurance adjuster needs to take measurements at the accident scene to determine such things as distance of skid marks or distance between objects. This is typically accomplished by a wheeled measuring device.

A wheeled measuring device is a wheel with a counter that is attached to the end of a shaft. The wheel is rolled along the ground between two points. As the wheel turns, the distance traveled is accumulated on a counter.

At nighttime, it is difficult to see where to measure and the amount on the counter. A flashlight is used to illuminate the area and to read the counter. This operation requires two hands—one hand to operate the wheeled measuring device, and one hand to operate the flashlight. This is particularly cumbersome when a person needs to record the measurement. This requires shuffling the wheeled measuring device, flashlight, and paper and pen.

What the art lacks is a holder for a flashlight to provide hands free illumination to a work area. In particular, the art lacks a flashlight holder that can removably clamp onto an object.

SUMMARY OF THE INVENTION

The present invention provides a flashlight holder comprising a clamp assembly having an opening end and a base end, a cradle disposed on the base end of the clamp assembly, and at least one retaining strap that attaches to the flashlight holder to secure a flashlight with an illumination end and a butt end in the flashlight holder, wherein the flashlight holder has a first end proximal to the illumination end of the flashlight, and a second end proximal to the butt end of the flashlight.

Also provided is a method of securing a flashlight to an object comprising: providing a flashlight holder comprising a clamp assembly having an opening end and a base end, a cradle disposed on the base end of the clamp assembly, and at least one retaining strap that attaches to the flashlight holder to secure a flashlight with an illumination end and a butt end in the flashlight holder, wherein the flashlight holder has a first end proximal to the illumination end of the flashlight, and a second end proximal to the butt end of the flashlight; attaching the flashlight holder to an object; and disposing the flashlight in the flashlight holder.

Also provided is a method of illuminating a wheeled measuring device and area surrounding the wheeled measuring device comprising: providing the wheeled measuring device comprising a shaft, a wheel axially attached to the shaft, and a counter engaged to the wheel; attaching a flashlight holder to the shaft on the wheeled measuring device, wherein the flashlight holder comprises a clamp assembly having an opening end and a base end, a riser disposed on the base end of the clamp assembly, a cradle disposed on the riser, and at least one retaining strap that attaches to the flashlight holder to secure a flashlight with an illumination end and a butt end in the flashlight holder, wherein the flashlight holder has a first end proximal to the illumination end of the flashlight, and a second end proximal to the butt end of the flashlight, wherein the riser has a first height at the first end of the flashlight holder and a second height at the second end of the flashlight holder; disposing a flashlight in the flashlight holder; and powering the flashlight to provide illumination.

In these methods, the flashlight can be disposed in the flashlight holder before or after the flashlight holder is attached to the object.

DETAILED DESCRIPTION OF THE INVENTION

The present invention is directed to a flashlight holder to secure a flashlight to an object. The flashlight holder can be moved from one object to another. The flashlight holder has a clamp assembly to clamp onto an object. Typically, the object is an elongate member. Preferably, the clamp assembly is adjustable to accommodate varying widths of the objects that it clamps onto. Also, the flashlight holder can accommodate varying diameters of flashlights.

A preferred flashlight is a barrel flashlight. The diameter of a flashlight barrel varies depending upon the size of the battery in the flashlight. Typical sizes of batteries range from D to C to AA to AAA. Not knowing the size of flashlight that a user may desire to use in the flashlight holder, it is preferable to include means for securing a flashlight of any diameter. Another variable is the length of the flashlight barrel. There can be one or more batteries placed in series in a flashlight barrel. It is preferable to design the flashlight holder to accommodate flashlights of varying length.

Figure 1:
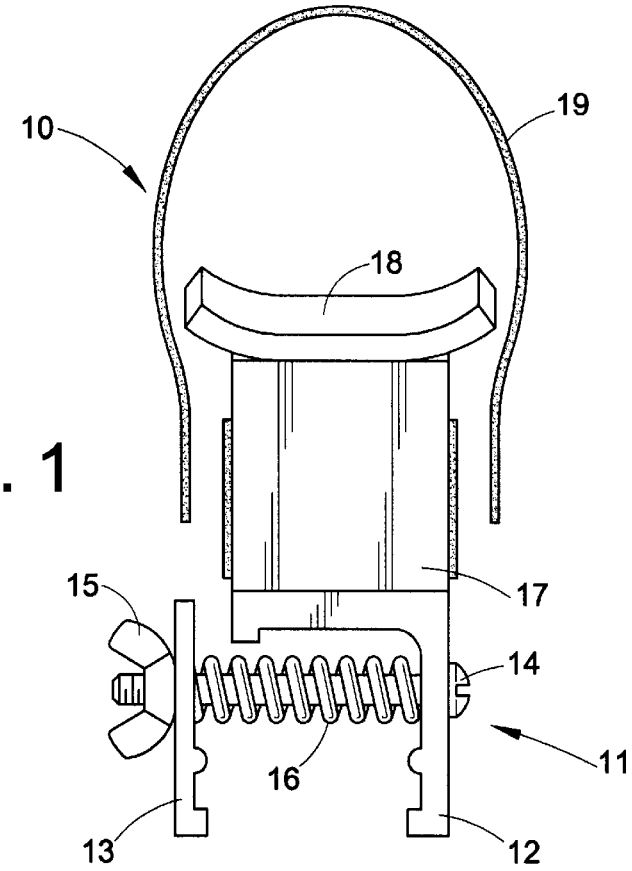
FIG. 1 is an end view of a preferred embodiment of the invention showing the clamp assembly, the riser, the cradle, and the retaining strap.

Referring to FIG. 1, the flashlight holder (10) is shown. The flashlight holder (10) has a first end that is proximal to the illumination end of a flashlight, and a second end that is proximal to the butt end of a flashlight.

The clamp assembly (11) preferably comprises a base and an integrally connected first side extending perpendicularly away from the base (12). A second side (13) is mounted opposite of the first side. The second side is removably attached to the base and first side (12). The second side is variably attached with at least one bolt (14) and nut (15) with a spring (16) disposed around bolt (14) in an area between the first side (12) and second side (13). Preferably, nut (15)

is a wing nut. The clamp assembly can be provided such that it is reversible for left hand or right hand operation. Alternatively, the clamp can wrap around the object that it is attached to.

Attached to the base is a cradle (18). The cradle (18) is preferably curved upward on the sides to aid in retaining the flashlight in the holder. Preferably, a riser (17) is disposed between the clamp assembly (11) and cradle (18).

The riser (17) has a first height at the first end of the flashlight holder (10) and a second height at the second end of the flashlight holder (10). The first height and the second height can be the same. For certain applications, such as attachment to a wheeled measuring device, it is desired to aim the flashlight to a desired area. In this application, it is desired to aim the flashlight closer to the wheel and the counter. To accomplish this, the second end has a height that is greater than the first.

For an application where the relationship between where the flashlight holder is mounted and the area desired to be illuminated is known, the difference in height between the second end and the first end can be fixed. For applications where the relationship is not known or is variable, the riser (17) can be adjustable to vary the difference between the first end height and the second end height. Generally, the second end height will be larger than the first end height, but in some instances, the first end height will be larger than the second end height.

A flashlight is secured to the flashlight holder by at least one retaining strap (19). The retaining strap has to secure the flashlight in the holder for the use desired for the flashlight holder. The retaining strap can be one piece that is sufficiently wide to secure the flashlight in the flashlight holder. Multiple retaining straps can be used as well, as long as there are a sufficient number of them to secure the flashlight in the flashlight holder.

Retaining strap (19) can be a hook and loop fastener, such as VELCRO® fastener, an elastic member, a strap and hook fastener, or a combination thereof. Preferably, the retaining strap is a hook and loop fastener. A strap and hook fastener comprises a strap with spaced apart holes in the strap. The holes in the strap attach over a hook that is mounted on the flashlight holder. The strap is adjusted around the flashlight to a sufficiently snug fit, and the hole in the strap closest to the hook is placed over the hook. By hook, it is meant that the hook can be straight or curved.

One or both ends of the retaining strap (19) can be adjustable. One end of the retaining strap (19) can be fixedly attached to the flashlight holder, while the other end can be adjusted to accommodate different sizes of flashlights. The retaining strap (19) can be attached to the flashlight holder (10) at the clamp assembly (11), riser (17), cradle (18), or a combination thereof. Preferably, the retaining strap (19) is attached to the riser (17) with a hook and loop fastener. One side of the hook and loop fastener is attached to the sides of the riser (17). The other side of the hook and loop fastener can be attached and removed to allow a flashlight to be placed in the flashlight holder and removed.

If the retaining strap (19) is an elastic member, then both ends of the elastic member can be attached to the flashlight holder (10). The elastic member is stretched to allow a flashlight to be slipped between the cradle (18) and retaining strap (19), and then the elastic member relaxes to hold the flashlight in the flashlight holder (10).

Materials for making the clamp assembly (11), riser (17), and cradle (18) can be any known material that provides for rigid support. Suitable examples include, but are not limited to metals, plastics, woods, ceramics, or a combination thereof. Preferably, the material selected provides for the lowest cost to manufacture the flashlight holder.

Preferably, the cradle (18) is fabricated from a material that provides slip resistance. Alternatively, the cradle (18) can be covered with a material that provides slip resistance. Also, it is preferable that the cradle (18) and/or the material covering the cradle (18) not be abrasive to the flashlight to prevent scratching the flashlight. Preferably, the covering material is rubber or other elastomers.

Attaching the clamp assembly (11) to riser (17) or cradle (18) and riser (17) to cradle (18) can be accomplished by any means that provides for secure attachment. For example, the attachment means can be at least one of an adhesive, a weld, or a fastener. Suitable fasteners include, but are not limited to, screws, bolts, or rivets.

Alternatively, the parts of the flashlight holder do not have to be independent components. One or more of the components of the flashlight holder can be provided as a unitary component. For example, the cradle can be integral to the riser, or the riser can be integral with the clamp assembly, or the cradle, riser, and clamp assembly can be integral components.

FIGS. 2A, 2B, 3A, and 3B are views of a preferred embodiment of the invention. These figures show preferred dimensions and assembly for the flashlight holder.

Figure 4:
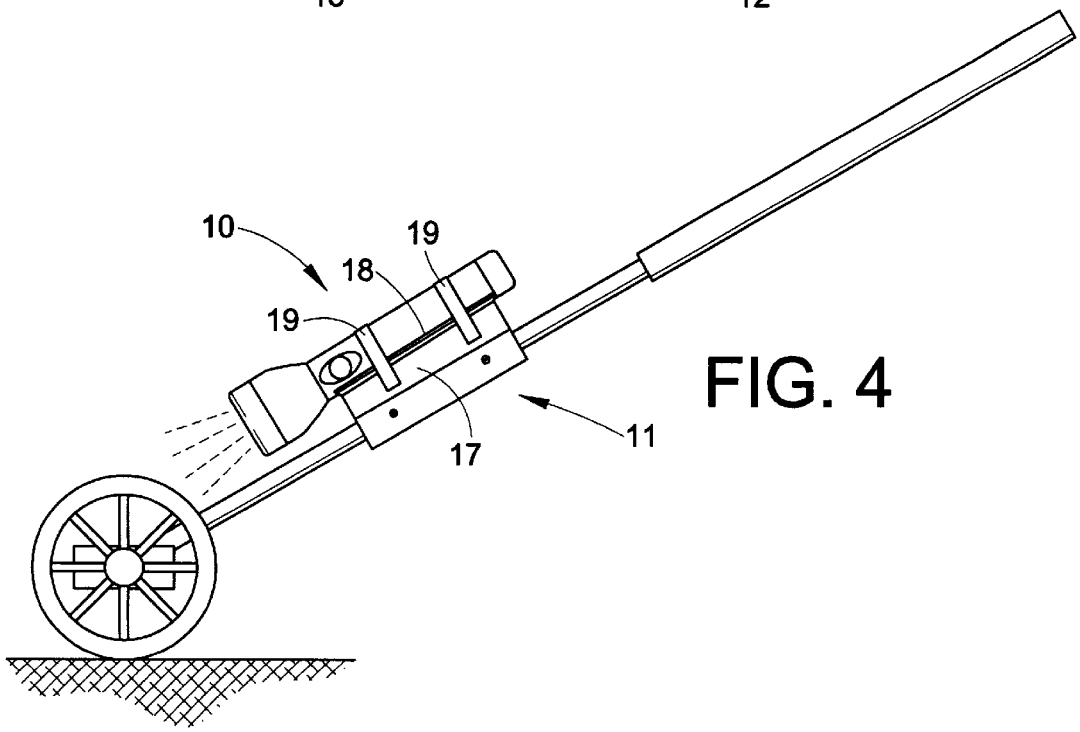
FIG. 4 is a schematic drawing showing a preferred use of the flashlight holder attached to a wheeled measuring device.
Figure 2A:
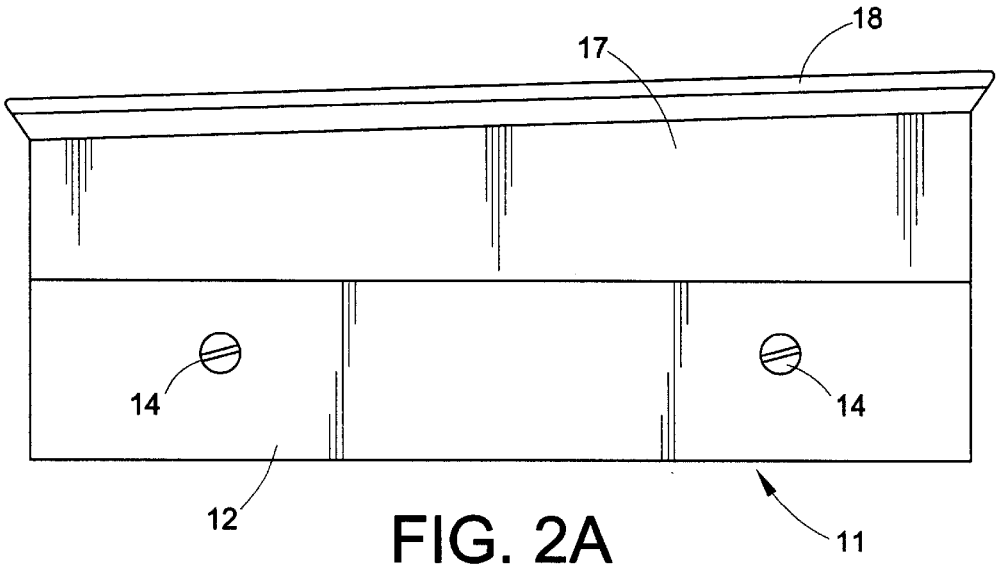
FIG. 2A and 2B are side views of a preferred embodiment of the invention showing the clamp assembly, the riser, and the cradle.
Figure 2B:
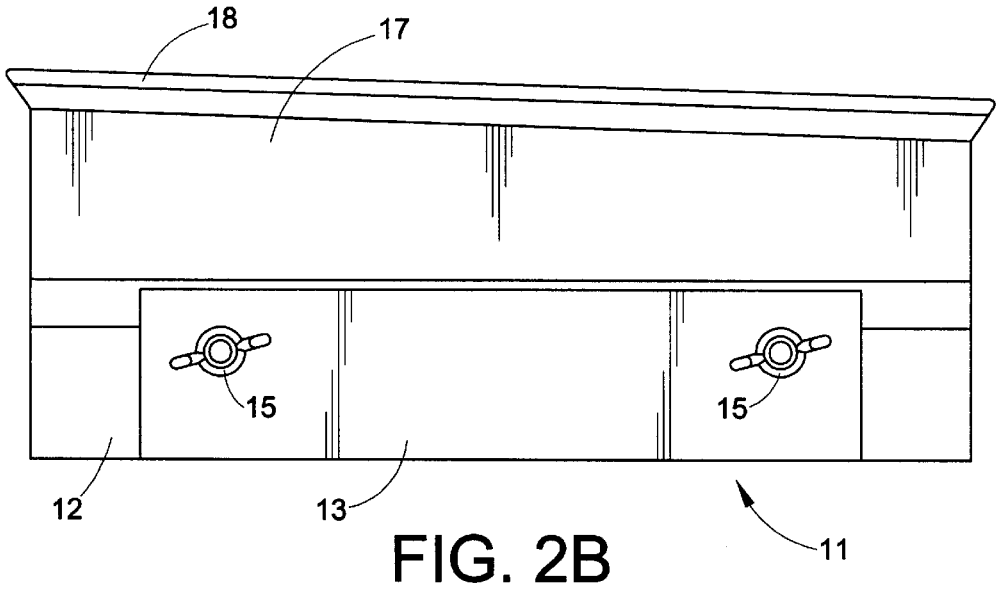
Figure 3A:
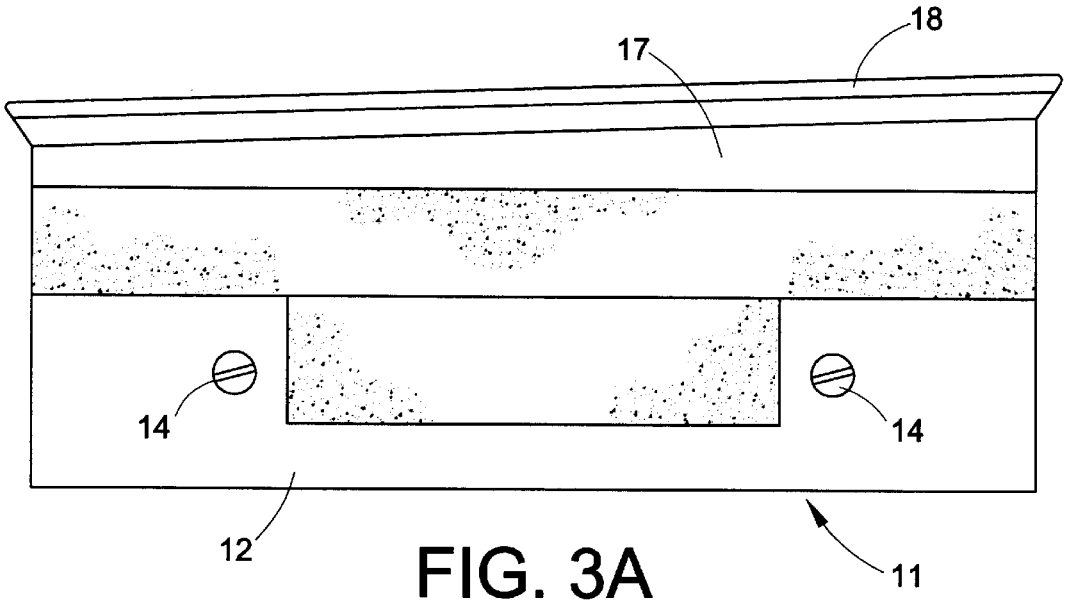
FIG. 3A is a side view of a preferred embodiment of the invention.
Figure 3B:
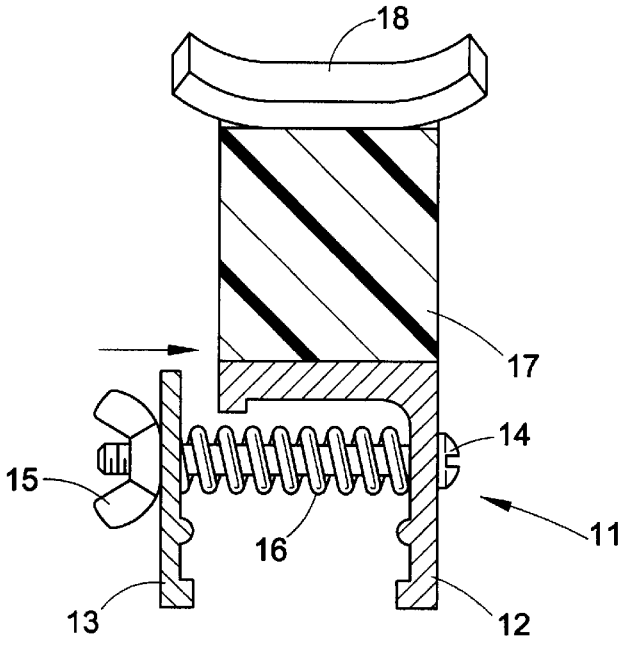
FIG. 3B is an end view of a preferred embodiment of the invention.

In a preferred use of the invention, the flashlight holder is clamped onto a wheeled measuring device (FIG. 4). The flashlight illuminates the wheel and counter area.

Also provided is a method of securing a flashlight to an object. First, a flashlight holder is provided that comprises a clamp assembly having an opening end and a base end, a cradle disposed on the base end of the clamp assembly, and at least one retaining strap that attaches to the flashlight holder to secure a flashlight with an illumination end and a butt end in the flashlight holder, wherein the flashlight holder has a first end proximal to the illumination end of the flashlight, and a second end proximal to the butt end of the flashlight. Next, a flashlight can be disposed in the flashlight holder and then secured to the object, or the flashlight holder can be secured to the object and then the flashlight disposed in the flashlight holder.

It should be appreciated that the present invention is not limited to the specific embodiments described above, but includes variations, modifications and equivalent embodiments defined by the following claims.

What is claimed is:

1. A flashlight holder comprising a clamp assembly having an opening end and a base end, a riser disposed on the base end of the clamp assembly, a cradle disposed on the riser and at least one retaining strap that attaches to the flashlight holder to secure a flashlight with an illumination end and a butt end in the flashlight holder, wherein the flashlight holder has a first end proximal to the illumination end of the flashlight, and a second end proximal to the butt end of the flashlight.

2. The flashlight holder of claim 1, wherein the riser has a first height at the first end of the flashlight holder and a second height at the second end of the flashlight holder.

3. The flashlight holder of claim 2, wherein the second height is greater than the first height.

4. The flashlight holder of claim 2, wherein the riser is adjustable to provide a difference between the first height and the second height.

5. The flashlight holder of claim 2, wherein the retaining strap is mounted to at least one of the clamp assembly, the riser, and the cradle.

6. The flashlight holder of claim 2, wherein the retaining strap is selected from the group consisting of hook and loop fastener, elastic, and strap and hook fastener.

7. The flashlight holder of claim 2, wherein at least two of the clamp assembly, the riser, and the cradle are provided as an integral component.

8. The flashlight holder of claim 1, wherein a slip resistant material covers the cradle.

9. The flashlight holder of claim 8, wherein the slip resistant material is selected from the group consisting of rubbers, elastomers, and mixtures thereof.

10. The flashlight holder of claim 2, wherein the clamp assembly, riser, and cradle are each made of a material selected from the group consisting of metal, wood, plastic, ceramic, and combinations thereof.

11. The flashlight holder of claim 2, further comprising a wheeled measuring device comprising a shaft, a wheel axially attached to an end of the shaft, and a counter in contact with the wheel for recording distances traveled by the wheel, wherein the flashlight holder is mounted on the shaft of the wheeled measuring device with the first end proximal to the wheel attached end of the shaft.

12. The flashlight holder of claim 1, wherein the clamp assembly comprises an integrally connected first side connected to the base end and extending perpendicularly away from the base end, a second side removably attached to the base and first side, and wherein the second side is connected to the first side by at least one bolt and nut and a spring disposed around the bolt.

13. A method of securing a flashlight to an object comprising:

a. providing a flashlight holder comprising a clamp assembly having an opening end and a base end, a riser disposed on the base end of the clamp assembly, a cradle disposed on the riser and at least one retaining strap that attaches to the flashlight holder to secure a flashlight with an illumination end and a butt end in the flashlight holder, wherein the flashlight holder has a first end proximal to the illumination end of the flashlight, and a second end proximal to the butt end of the flashlight;

b. attaching the flashlight holder to an object; and c. disposing the flashlight in the flashlight holder.

14. The method of claim 13, wherein the disposing the flashlight in the flashlight holder is one of disposing the flashlight in the flashlight holder before the flashlight holder is attached to the object, and disposing the flashlight in the flashlight holder after the flashlight is attached to the object.

15. The method of claim 13, wherein the riser has a first height at the first end of the flashlight holder and a second height at the second end of the flashlight holder.

16. The method of claim 15, wherein the second height is greater than the first height.

17. The method of claim 15, wherein the riser is adjustable to provide a difference between the first height and the second height.

18. The method of claim 15, wherein the retaining strap is mounted to at least one of the clamp assembly, the riser, and the cradle.

19. The method of claim 15, wherein the retaining strap is selected from the group consisting of hook and loop fastener, elastic, and strap and hook fastener.

20. The method of claim 15, wherein at least two of the clamp assembly, the riser, and the cradle are provided as an integral component.

21. The method of claim 13, wherein a slip resistant material covers the cradle.

22. The method of claim 21, wherein the slip resistant material is selected from the group consisting of rubbers, elastomers, and mixtures thereof.

23. The method of claim 15, wherein the clamp assembly, riser, and cradle are each made of a material selected from the group consisting of metal, wood, plastic, ceramic, and combinations thereof.

24. The method of claim 13, wherein the clamp assembly comprises an integrally connected first side connected to the base end and extending perpendicularly away from the base end, a second side removably attached to the base and first side, and wherein the second side is connected to the first side by at least one bolt and nut and a spring disposed around the bolt.

25. The method of claim 13, wherein the clamp assembly wraps around the object.

26. A method of illuminating a wheeled measuring device and area surrounding the wheeled measuring device comprising:

a. providing the wheeled measuring device comprising a shaft, a wheel axially attached to the shaft, and a counter engaged to the wheel;

b. attaching a flashlight holder to the shaft on the wheeled measuring device, wherein the flashlight holder comprises a clamp assembly having an opening end and a base end, a riser disposed on the base end of the clamp assembly, a cradle disposed on the riser, and at least one retaining strap that attaches to the flashlight holder to secure a flashlight with an illumination end and a butt end in the flashlight holder, wherein the flashlight holder has a first end proximal to the illumination end of the flashlight, and a second end proximal to the butt end of the flashlight, wherein the riser has a first height at the first end of the flashlight holder and a second height at the second end of the flashlight holder;

c. disposing a flashlight in the flashlight holder; and d. powering the flashlight to provide illumination.

27. The method of claim 26, wherein the disposing the flashlight in the flashlight holder is one of disposing the flashlight in the flashlight holder before the flashlight holder is attached to the object, and disposing the flashlight in the flashlight holder after the flashlight is attached to the object.

28. The method of claim 26, wherein the second height is greater than the first height such that the flashlight holder is positioned to illuminate the wheel and counter on the wheeled measuring device.

29. The method of claim 26, wherein the retaining strap is selected from the group consisting of hook and loop fastener, elastic, and strap and hook fastener.

30. The method of claim 26, wherein the cradle is covered with a slip resistant material selected from the group consisting of rubbers, elastomers, and mixtures thereof.

31. The method of claim 26, wherein the clamp assembly, riser, and cradle are each made of a material selected from the group consisting of metal, wood, plastic, ceramic, and combinations thereof.

32. The method of claim 26, wherein the clamp assembly comprises an integrally connected first side connected to the base end and extending perpendicularly away from the base end, a second side removably attached to the base and first side, and wherein the second side is connected to the first side by at least one bolt and nut and a spring disposed around the bolt.

33. The method of claim 26, wherein the clamp assembly wraps around the shaft on the wheeled measuring device.

* * * * *